US008322407B2

(12) United States Patent
Reynolds

(10) Patent No.: US 8,322,407 B2
(45) Date of Patent: Dec. 4, 2012

(54) HEAT EXCHANGER WITH PRESSURE REDUCTION

(75) Inventor: Brian Reynolds, Plain City, OH (US)

(73) Assignee: Honda Motor Co., Ltd., Tokyo (JP)

( * ) Notice: Subject to any disclaimer, the term of this patent is extended or adjusted under 35 U.S.C. 154(b) by 1241 days.

(21) Appl. No.: 12/111,391

(22) Filed: Apr. 29, 2008

(65) Prior Publication Data

US 2009/0266510 A1 Oct. 29, 2009

(51) Int. Cl.
*F28F 9/02* (2006.01)
*F28D 7/06* (2006.01)

(52) U.S. Cl. ..... 165/173; 165/175

(58) Field of Classification Search ..... 165/173, 165/174, 175, 176
See application file for complete search history.

(56) References Cited

U.S. PATENT DOCUMENTS

| | | | | |
|---|---|---|---|---|
| 4,465,129 | A | 8/1984 | Baldensperger et al. | |
| 5,123,482 | A * | 6/1992 | Abraham | 165/173 |
| 5,195,581 | A * | 3/1993 | Puntambekar et al. | 165/173 |
| 5,214,848 | A * | 6/1993 | Lelievre | 29/890.053 |
| 5,228,512 | A | 7/1993 | Bretl et al. | |
| 5,251,694 | A * | 10/1993 | Chigira | 165/173 |
| 5,918,667 | A | 7/1999 | Chiba et al. | |
| 6,263,570 | B1 | 7/2001 | Cazacu | |
| 6,296,051 | B1 * | 10/2001 | Sahnoun et al. | 165/173 |
| 6,446,337 | B1 * | 9/2002 | Halm et al. | 29/890.052 |
| 6,581,679 | B2 | 6/2003 | Fischer et al. | |
| 6,971,444 | B2 * | 12/2005 | Lamich | 165/173 |
| 2007/0000657 | A1 | 1/2007 | Emrich et al. | |

FOREIGN PATENT DOCUMENTS

| | | | |
|---|---|---|---|
| JP | 60149895 | A * | 8/1985 |

* cited by examiner

*Primary Examiner* — Tho V Duong
(74) *Attorney, Agent, or Firm* — Clifford B. Vaterlaus; Emerson Thomson Bennett

(57) ABSTRACT

A heat exchanger and related method of making is disclosed herewith. The heat exchanger may have first and second fluid reservoirs that retain a quantity of fluid and also a plurality of tubes that extend between the first and second reservoirs and circulate the fluid therebetween. First and second header plates may be retained respectively in the first and second reservoirs through which the plurality of tubes are mounted. First and second pressure reduction plates may each have a plurality of apertures that respectively encompass first and second ends of each of the plurality of tubes. The plurality of apertures may have tapered side walls that taper outwardly from the respective ends, to reduce turbulence of the fluid between the plurality of tubes and the first and second reservoirs.

18 Claims, 6 Drawing Sheets

HEAT EXCHANGER WITH PRESSURE REDUCTION

I. BACKGROUND OF THE INVENTION

A. Field of Invention

This invention generally relates to the art of methods and apparatus regarding heat exchangers, and more particularly to methods and apparatuses regarding a vehicle radiator for use in reducing the temperature of liquid coolant or for use as an air to air heat exchanger.

B. Description of the Related Art

Heat exchangers, such as vehicle radiators, typically include an arrangement of tubes for circulating coolant and thereby radiating heat into the ambient environment. These tubes are inserted into a header plate so as to retain the tubes, and are brazed into position to provide mechanical support.

As a result practical limitations in the manufacturing process, the ends of the tubes are placed in the header plate so that the ends of the tubes extend past the plane of the header plate, into the fluid reservoirs. As coolant is driven through the system, turbulence is encountered along the protruding length of the tubes. This creates back pressure within the system, resulting in reduced pressure of the coolant fluid actually entering the tubes. These pressure losses reduce the flow of coolant and require the system to do more work, thereby reducing energy efficiency and the rate of heat exchange.

In order to overcome these difficulties, methods and apparatuses are needed that would produce a heat exchanger having reduced internal turbulence and improved fluid flow, to thereby increase the rate of heat exchange and reduce the work needed to drive the system.

II. SUMMARY OF THE INVENTION

Some embodiments of the present invention relate to a heat exchanger having first and second fluid reservoirs that retain a quantity of fluid and one or more tubes that circulate the fluid between the first and second reservoirs. A header plate is retained in a reservoir, through which the tube is mounted. A pressure reduction plate has one or more apertures that encompass an end of the tube. These apertures have sloped side walls that slope outwardly from the end, to reduce turbulence of the fluid between the tube and the respective reservoir.

Other embodiments of the present invention relate to a heat exchanger having first and second fluid reservoirs that retain a quantity of fluid and also a plurality of tubes that extend between the first and second reservoirs and circulate the fluid therebetween. First and second header plates are provided, retained respectively in the first and second reservoirs, through which the plurality of tubes are mounted. First and second pressure reduction plates each have a plurality of apertures that respectively encompass first and second ends of each of the plurality of tubes. The plurality of apertures have tapered side walls that taper outwardly from the respective ends, to reduce turbulence of the fluid between the plurality of tubes and the first and second reservoirs.

Still other embodiments of the present invention relate to a method of constructing a heat exchanger. A plurality of apertures are formed having sloped side walls in a first pressure reduction plate. A plurality of apertures are formed also having sloped side walls in a second pressure reduction plate. A first end of each of a plurality of circulating tubes are mounted to a first header plate. Similarly, a second end of each of the plurality of circulating tubes are mounted to a second header plate. The first ends of each of the plurality of circulating tubes are affixed into the plurality of apertures of the first pressure reduction plate, so that the respective apertures respectively encompass and slope outwardly from the first ends. The second ends of each of the plurality of circulating tubes are affixed into the plurality of apertures of the second pressure reduction plate, so that the respective apertures respectively encompass and slope outwardly from the second ends. The first header plate, the first ends, and the first pressure reduction plate are enclosed within a first fluid reservoir that retains a quantity of fluid. Also, the second header plate, the second ends, and the second pressure reduction plate are enclosed within a second fluid reservoir that retains a quantity of fluid, so that the plurality of tubes extend between the first and second reservoirs and circulate the fluid therebetween.

Benefits and advantages to this convention will become apparent to those skilled in the art to which it pertains upon reading and understanding of the following detailed specification.

III. BRIEF DESCRIPTION OF THE DRAWINGS

The invention may take physical form in certain parts and arrangement of parts, embodiments of which will be described in detail in this specification and illustrated in the accompanying drawings which form a part hereof and wherein.

Figure 3A:
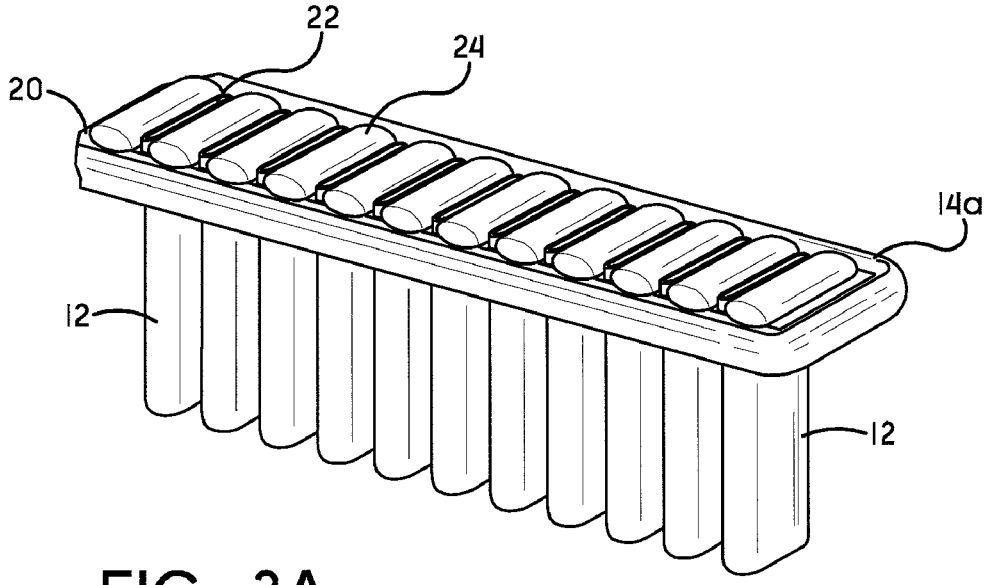
Figure 3B:
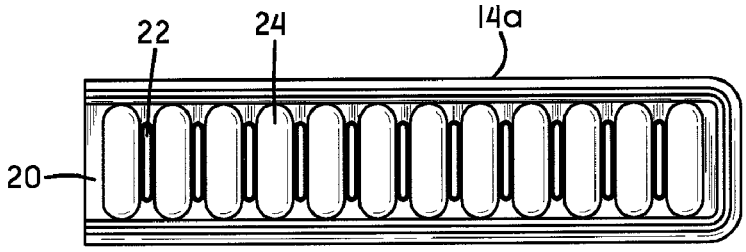
Figure 3C:
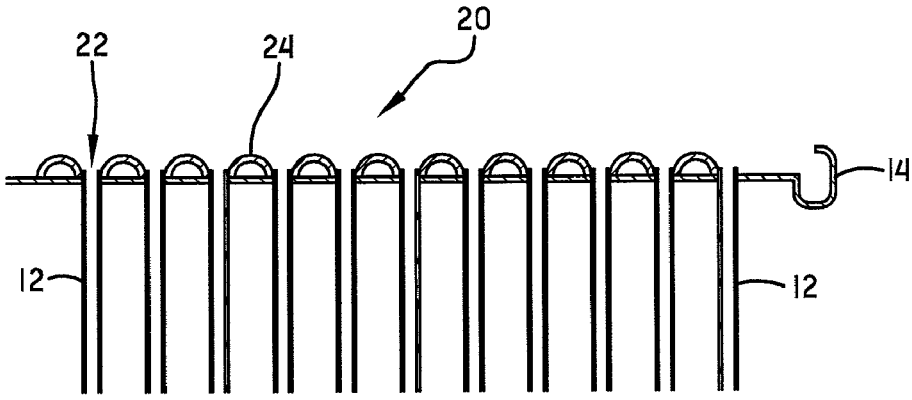

FIGS. 3A, 3B, and 3C are respective assembled perspective, plan, and assembled side-sectional views illustrating a heat exchanger with a pressure reduction plate in accordance with one embodiment of the present invention.

Figure 4A:
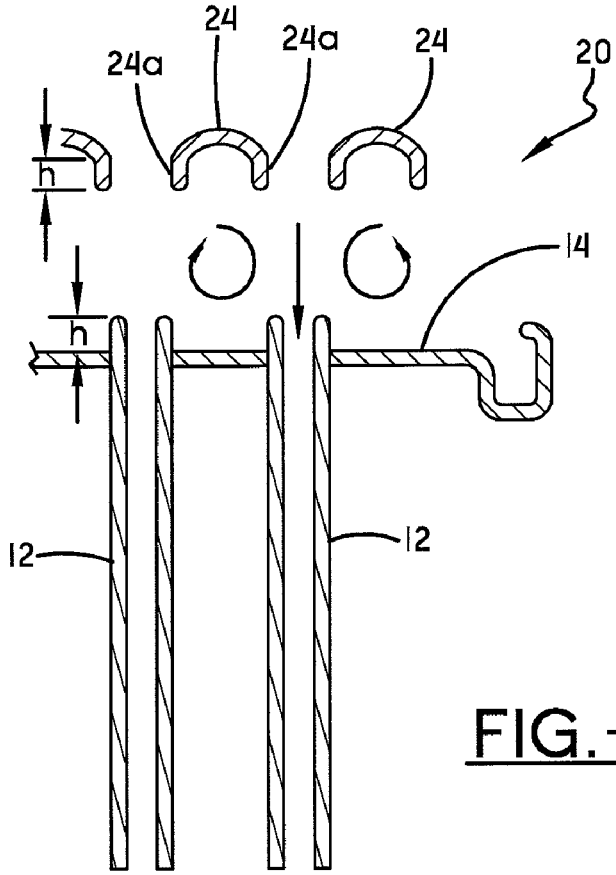
Figure 4B:
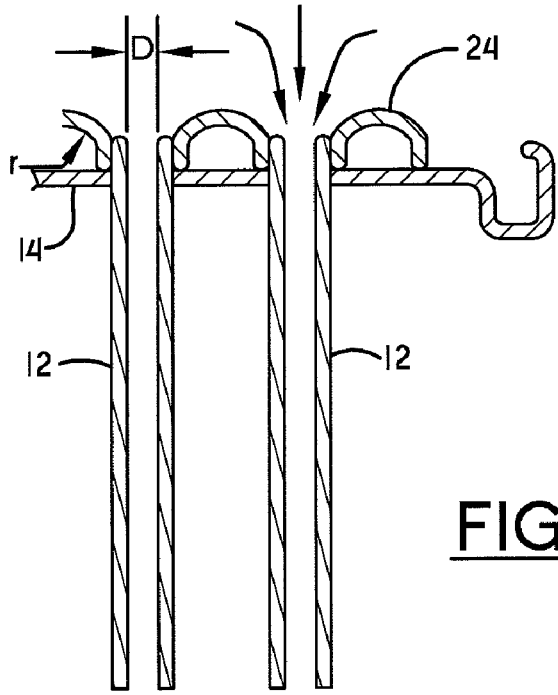
Figure 4C:
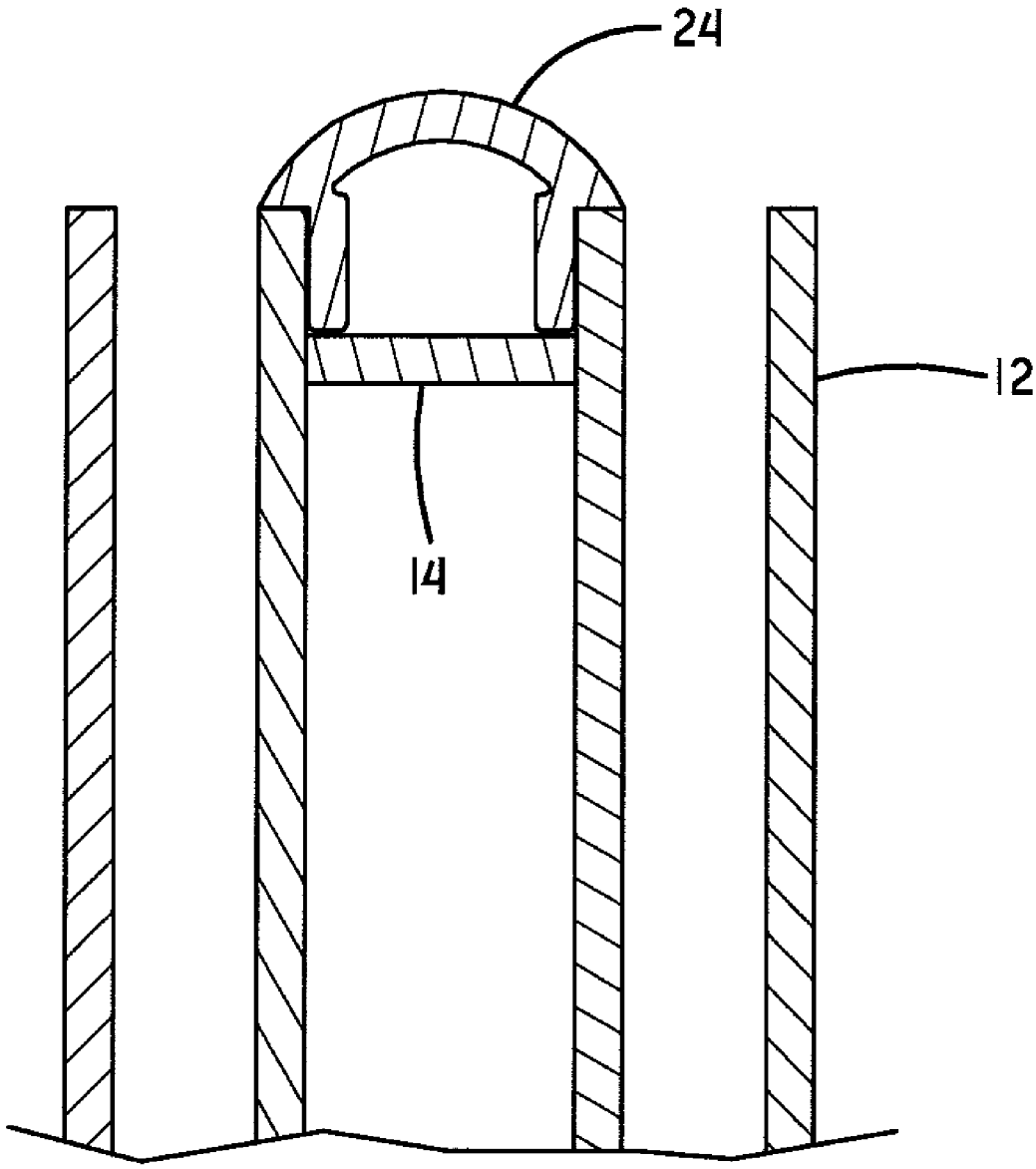

FIGS. 4A, 4B and 4C are exploded and assembled side-sectional views of a heat exchanger with a pressure reduction plate, with FIG. 4C having a flush attachment in accordance with one embodiment of the present invention.

Figure 5:
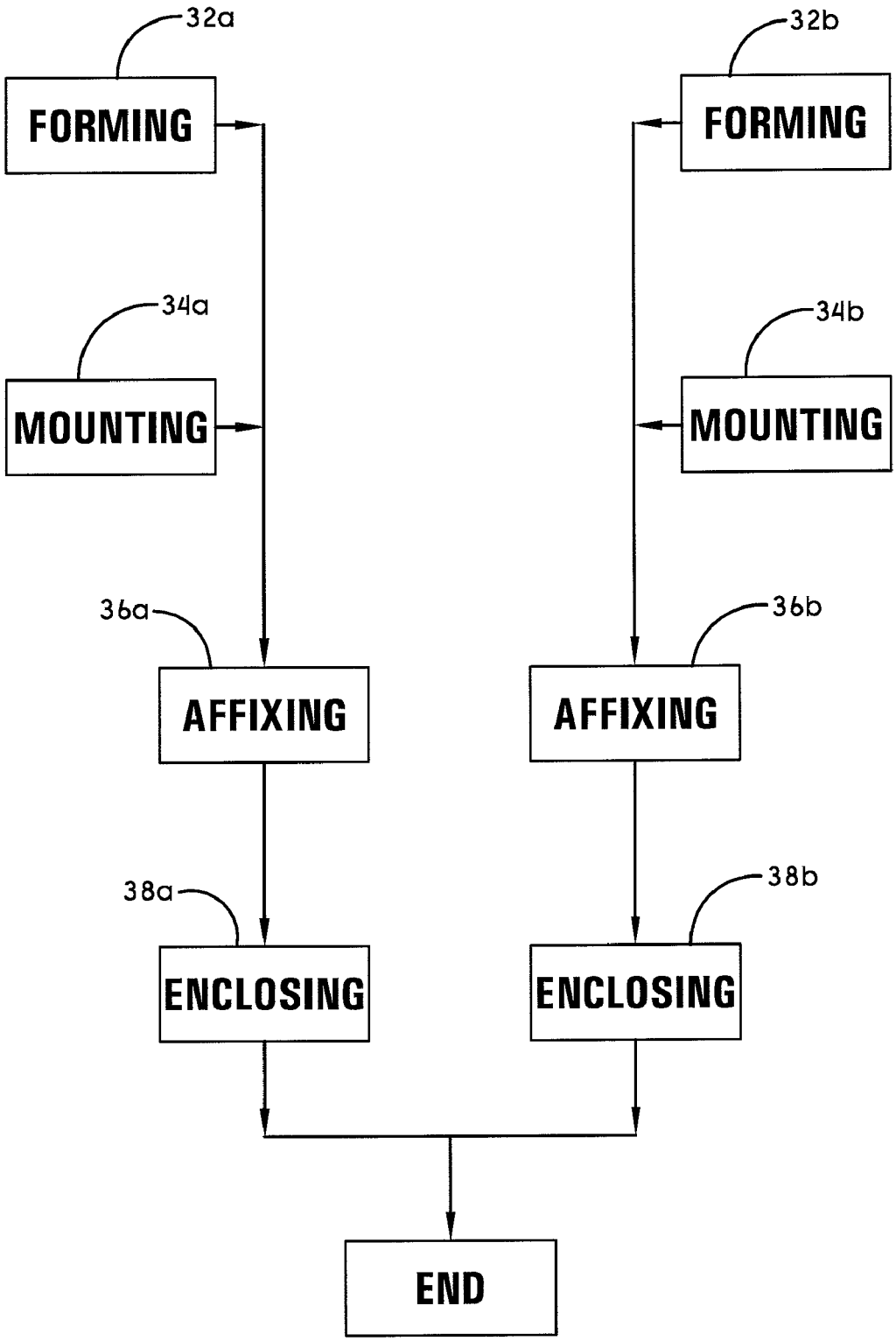

FIG. 5 is a flow chart indicating the steps in a method of constructing a heat exchanger, in accordance with one embodiment of the present invention.

IV. DETAILED DESCRIPTION OF THE INVENTION

The present invention generally relates to a heat exchanger, having a number of tubes and a header plate, retained within fluid reservoirs for promoting circulation and thus exchanging heat with the ambient environment. It is to be understood that this invention can be used with liquid fluids, such as liquid coolants, as well as gas fluids, such as air. The present heat exchanger employs one or more pressure reduction plates that have a plurality of apertures that respectively encompass the ends of the tubes. The apertures have tapered side walls that, in one embodiment, are radially curved side walls. These side walls may taper outwardly from the respective ends. In this way, the side walls reduce turbulence of the fluid between the protruding ends of the tubes and the fluid reservoirs.

Figure 1:
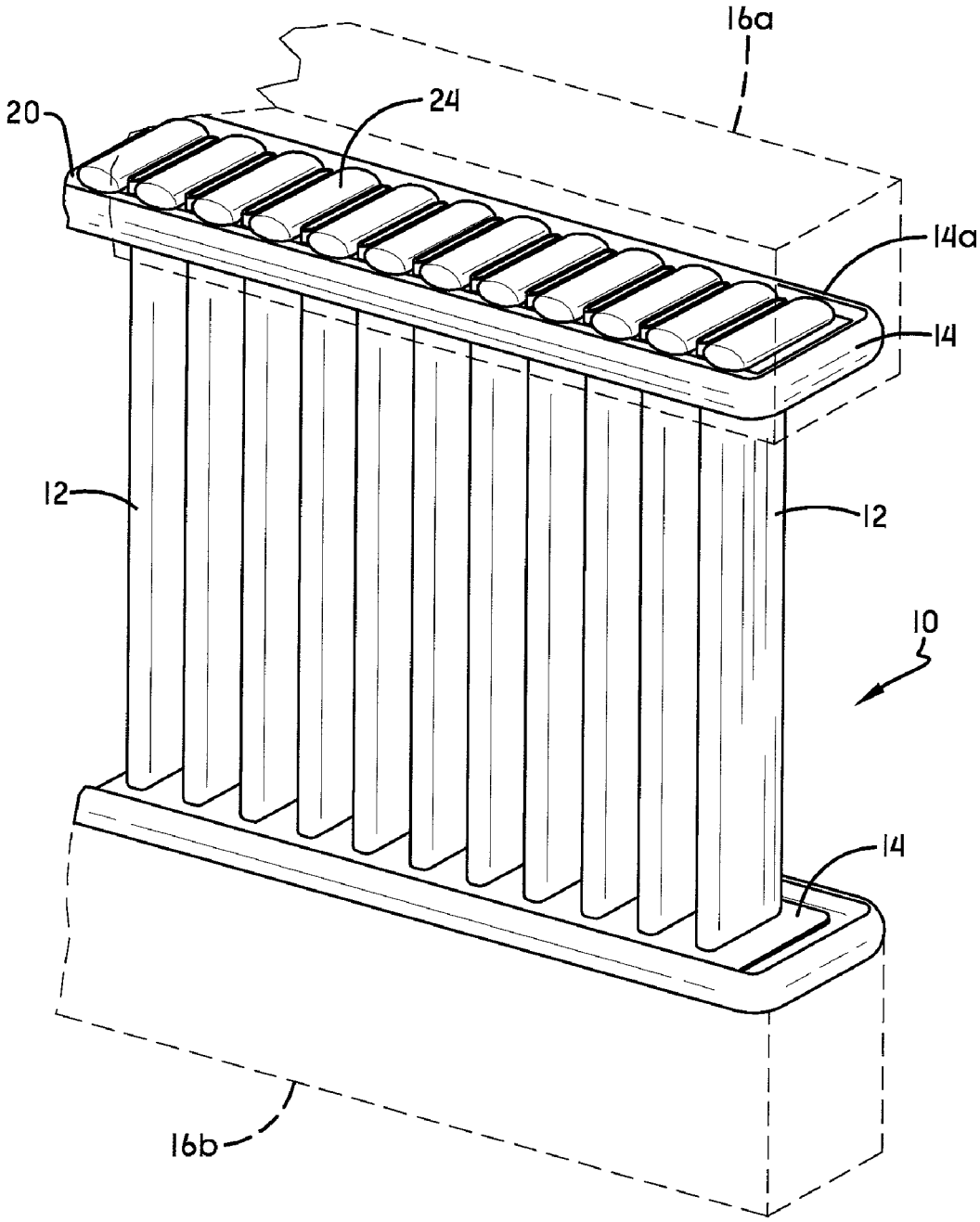
FIG. 1 is a perspective view of a heat exchanger in accordance with one embodiment of the present invention.

Referring now to the drawings wherein the showings are for purposes of illustrating embodiments of the invention only and not for purposes of limiting the same, and wherein like reference numerals are understood to refer to like components, FIG. 1 generally shows a heat exchanger 10 having a plurality of tubes 12 having ends received and retained in a header plate 14. First and second fluid reservoirs 16*a*, 16*b* (shown in phantom) are provided and may retain a quantity of fluid, such as a suitable liquid coolant used to exchange heat from a system with an ambient environment, such as, air at conventional outdoor temperatures. These tubes are also applicable in air to air heat exchangers.

With continuing reference to FIG. 1, for the embodiment shown, the heat exchanger 10 is a vehicle radiator of the type used to draw heat from a vehicle's power supply device and dissipate the heat into the surrounding air. It should be understood that the power supply device may be of any type chosen with the sound judgment of a person of skill in the art including, for some non-limiting examples, an internal combustion engine, an electric motor, and a hybrid engine/motor. According to one embodiment, the heat exchange process may be accelerated by using a plurality of radiator fins (not shown) over which air is blown by a fan (not shown). Such a fan may be powered in any manner chosen with sound judgment such as by the use of a belt or chain rotated from the vehicle's power supply device or an electric motor. However, it should be appreciated that the present invention is not limited to vehicle radiators and that the principles of the invention could be easily adapted to any other type of heat exchanger, for eliminating heat or for absorbing heat from a system, for cooling or refrigeration or for any other suitable application, such as is known in the art.

Still referring to FIG. 1, the plurality of tubes 12 may be used in transferring or circulating the fluid between the first and second reservoirs 16*a*, 16*b*. Such circulation is provided by a motor, which in a vehicle may be a water pump that is belt-driven by the vehicle's power supply device. The tubes 12 may be mounted substantially parallel to each other and extend between the first and second fluid reservoirs 16*a*, 16*b*. As indicated in the FIGURES, the tubes 12 may have a generally elongated sectional profile, that is a "stadium" shape having an elongated rectangular center portion capped by half-circular portions at opposite sides. In this way, the surface area of each tube is large with respect to the volume of the fluid flowing therethrough, so as to promote heat exchange with the ambient environment.

With reference now to all the FIGURES, each of the tubes 12 is connected to a header plate 14. The connection may be accomplished through the process of brazing, though any suitable bonding technique could alternatively be performed. There may be first and second header plates 14, with one placed at each end of the tubes 12. Each of these header plates 14 are retained in one of the first and second reservoirs 16*a*, 16*b* and are fluidly sealed for maintaining the fluid under pressure. As indicated especially in the perspective views, the header plate 14 may include an elevated rim 14*a* that retains the exterior perimeter of pressure reduction plate 20, as will be discussed hereinbelow.

Figure 2A:
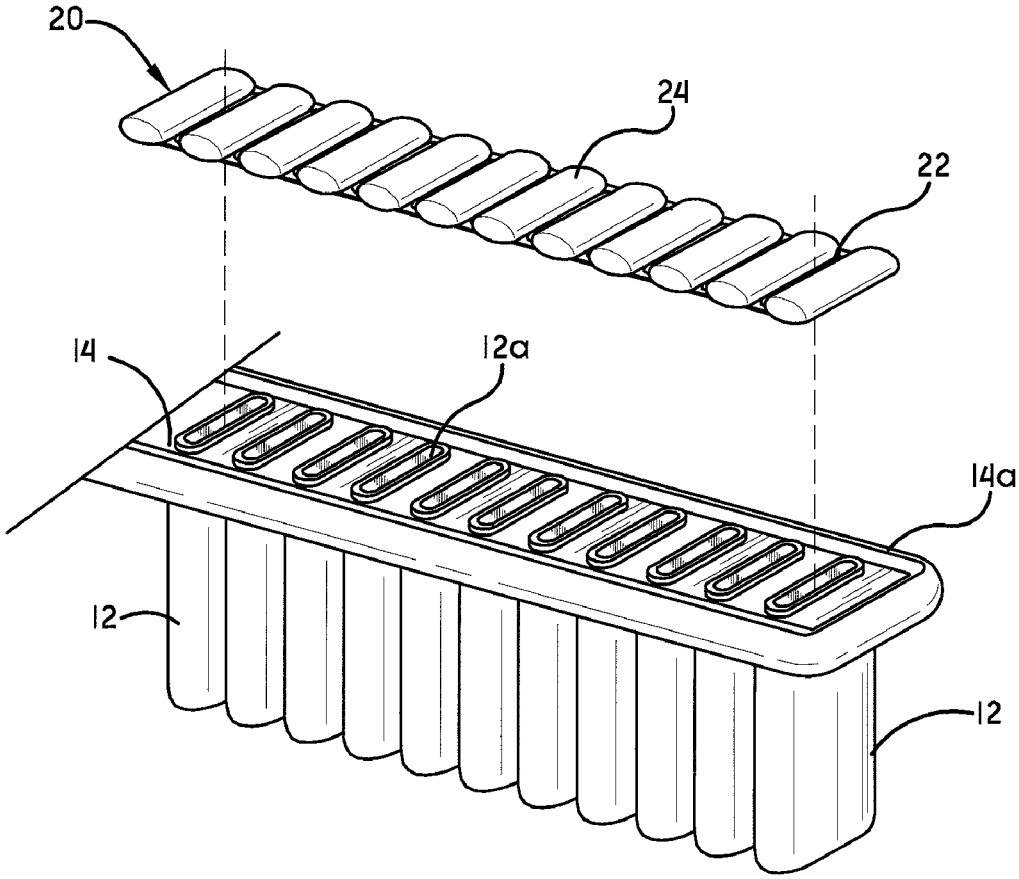
FIGS. 2A and 2B are respective exploded perspective and exploded side-sectional views depicting a heat exchanger with a pressure reduction plate in accordance with one embodiment of the present invention.
Figure 2B:
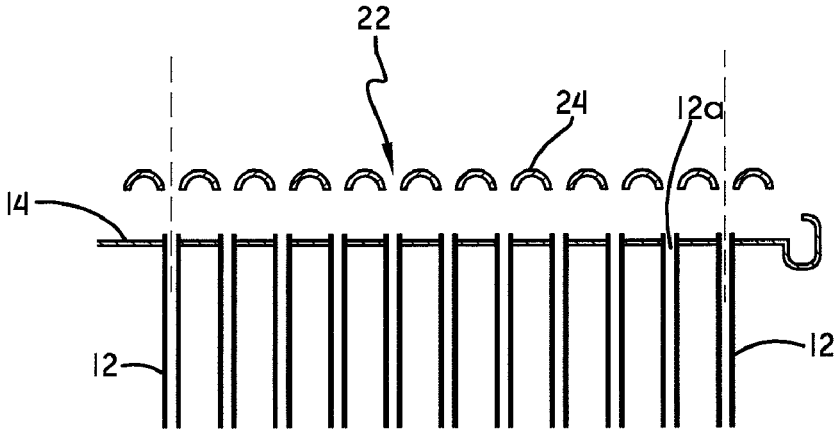

As indicated in FIGS. 2A and 2B, and especially FIG. 3A, the tubes 12 each have an end 12*a* that protrudes through the header plate 14, due to the aforementioned practical limitations of the manufacturing process. It is to be appreciated that each tube 12 has first and second ends 12*a* at opposite truncation points, and that each of these ends 12*a* are mounted to protrude respectively through each of the opposing first and second header plates 14 that are respectively retained in each of the first and second reservoirs 16*a*, 16*b*.

As shown in FIG. 4A, the ends 12*a* of the tubes 12 protrude through the plane of the header plate 14 by an amount indicated by h. As shown respectively in the exploded and assembled view of FIGS. 2A, 2B, 3A, 3B, and 3C, the pressure reduction plate 20 is provided to fit over the ends 12*a* of the tubes 12. The pressure reduction plate 20 has a number of apertures 22 that encompass the ends 12*a* of the tubes 12. The ends 12*a* of the tubes 12 are received in the apertures 22 of the respective first and second pressure reduction plates 20, so as to provide suitable engagement.

With reference again to all the FIGURES, the pressure reduction plates 20 substantially abut the header plates 14, so that the bottom portions of the apertures 22 are in contact with the planar surface of the respective header plate 14. The pressure reduction plates 20 are sized so that the perimeter of thereof fits inside the rim 14*a* of the header plate 14, and are thereby securely held in place against any lateral motion. The pressure reduction plates 20 may secured to the apertures 22 and/or the header plate through an interference fit, or with a fastener or a type of bonding process such as brazing.

As best seen in the side-sectional views, the apertures 22 have sloped or tapered side walls 24 that slope or taper outwardly from the ends 12*a* of the tubes 12. The side walls 24 may be curved side walls having a curved shape so as to expand outwardly from the respective ends 12*a*. In this manner, the side walls 24 reduce turbulence of the fluid between the tubes 12 and the respective reservoir 16*a*, 16*b*.

With particular reference to FIG. 4A, the ends 12*a* of the tubes 12 protrude through the plane of the header plate 14 by an amount h. The side walls 24 are sized so as to have a substantially flat portion 24*a* also having a height h that encompasses the ends 12*a* and thereby provide a substantially continuous surface between the interior diameters of the ends 12*a* and the curved side walls 24.

As shown particularly in FIG. 4B, the curved side walls 24 is of substantially constant thickness and may have a radius of curvature r that compares with the interior diameter D representing a width corresponding generally to a minor axis of the elongated sectional profile of the tube 12. In one embodiment, the ratio riD between the radius of curvature r and the diameter D of the tube 12 is at least 0.15. This ratio has been found to correspond to a pressure loss coefficient K =0.04, compared with a pressure loss coefficient K =0.78 for the previous-type arrangement where the end 12*a* of the tube 12 protrudes from the header plate 14 without using a pressure reduction plate 20 in accordance with the present invention.

As shown especially in the perspective views, the side walls 24 may be formed onto the pressure reduction plate 20 as "pill-shaped" indentations. Specifically, the shape of the side walls as illustrated would be described as a half-section geometrical solid called a "stadium of revolution" being essentially a cylinder having hemispherical caps on either end. This shape is easily formed into the pressure reduction plate 20 in a stamping operation. Though the curvature of the side walls 24 is neglected toward the ends of the apertures 22, the pressure-reduction benefits are nevertheless realized along the substantial length of the apertures 22. In this way, a practical compromise is realized between ease of manufacture and pressure efficiency. Of course, it is to be appreciated that any suitably shaped indentation could be contemplated without departing from the invention. For example, FIG. 4C illustrates an alternative embodiment where the sidewalls 24 are flush with the tube 12.

With reference again to all the FIGURES, as described above, the present invention represents a significant reduction in turbulence at the ends 12*a*, and thus provides a considerable improvement in fluid pressure through the tubes 12, thereby increasing system pressure efficiency and thus energy efficiency.

With reference now to FIG. 5, a method 30 is described of constructing a heat exchanger. A step 32*a* is performed of forming a plurality of apertures having sloped or tapered side walls in a first pressure reduction plate. A similar step 32*b* is performed of forming a plurality of apertures having sloped or tapered side walls in a second pressure reduction plate. It should be appreciated that either of the first or second pressure reduction plates can represent top or bottom portions of a heat exchanger and may, in one embodiment, be used interchangeably. Also, the steps of forming can be performed in any respective order.

With continuing reference to FIG. 5, in one embodiment the steps 32*a*, 32*b* of forming a plurality of apertures having sloped side walls includes forming a plurality of apertures having curved side walls. In this way, a flow pattern results in the heat exchanger that minimizes turbulence and thereby reduces back pressure in the system, thus promoting improved flow through the tubes.

Still referring to FIG. 5, a step 34*a* may be performed of mounting a first end of each of a plurality of circulating tubes to a first header plate. Similarly, a step 34*b* is performed of mounting a second end of each of the plurality of circulating tubes to a second header plate. In one embodiment, these ends of the tubes can be formed interchangeably and in any order. The steps 34*a*, 34*b* of mounting may include brazing the ends of the tubes into the respective header plates. It should be appreciated that the various brazing operations indicated above can be performed in any order, or can be performed simultaneously in a single brazing operation. Also, these steps 34*a*, 34*b* of mounting can be performed prior to, simultaneously, or subsequent to the steps 32*a*, 32*b* of forming the plurality of apertures in the pressure reduction plates.

With continuing reference to FIG. 5, a step 36*a* is performed of affixing the first ends of each of the plurality of circulating tubes into the plurality of apertures of the first pressure reduction plate, so that the respective apertures respectively encompass and slope outwardly from the first ends. A similar step 36*b* is performed of affixing the second ends of each of the plurality of circulating tubes into the plurality of apertures of the second pressure reduction plate, so that the respective apertures also respectively encompass and slope outwardly from the second ends.

With continuing reference to FIG. 5, in one embodiment, the steps 36*a*, 36*b* of affixing of the first and second ends of the plurality of tubes include affixing so that the first and second ends protrude respectively through the first and second header plates. The steps 36*a*, 36*b* of affixing can include making an interference fit around the apertures, or can entail the use of a fastener or a suitable bonding operation. Bonding can include brazing, and this can be performed concurrently with the brazing operations indicated above.

Still referring to FIG. 5, a step 38*a* can be performed of enclosing the first header plate, the first ends, and the first pressure reduction plate within a first fluid reservoir that retains a quantity of fluid. A similar step 38*b* can be performed of enclosing the second header plate, the second ends, and the second pressure reduction plate within a second fluid reservoir that retains a quantity of fluid. These steps 38*a*, 38*b* of enclosing can also be performed interchangeably or simultaneously, but are performed subsequent to the aforementioned steps, so as to produce a finished heat exchanger product in which the plurality of tubes extend between the first and second reservoirs and circulate the fluid therebetween.

Numerous embodiments have been described, hereinabove. It will be apparent to those skilled in the art that the above methods and apparatuses may incorporate changes and modifications without departing from the general scope of this invention. It is intended to include all such modifications and alterations insofar as they come within the scope of the appended claims or the equivalents thereof.

Having thus described the invention, it is now claimed:

1. A heat exchanger comprising:

first and second fluid reservoirs that retain a quantity of fluid;

at least one tube that circulates the fluid between the first and second reservoirs;

a header plate, retained in at least one of the first and second reservoirs, through which the at least one tube is mounted; and a pressure reduction plate having at least one aperture that encompasses an end of the at least one tube, the aperture having sloped side walls that slope outwardly from the end, to reduce turbulence of the fluid between the at least one tube and the respective reservoir, wherein at least one of the sloped side walls is of substantially constant thickness and defines an outer surface exposed in one of the reservoirs and also defines an inner surface opposite the outer surface and having an inner radius of curvature such that a ratio of the radius of curvature to a diameter of the at least one tube is at least 0.15.

2. The heat exchanger of claim 1, wherein the at least one tube is a plurality of tubes mounted substantially parallel and extending between the first and second fluid reservoirs.

3. The heat exchanger of claim 1, wherein the at least one tube has a generally elongated sectional profile, so as to promote heat exchange with the ambient environment.

4. The heat exchanger of claim 1, wherein the end of the at least one tube protrudes through the header plate.

5. The heat exchanger of claim 4, wherein the end of the at least one tube is received in the at least one aperture of the pressure reduction plate.

6. The heat exchanger of claim 1, wherein the header plate comprises first and second header plates, respectively retained in each of the first and second reservoirs, wherein the at least one tube comprises first and second ends that each protrude respectively through the first and second header plates.

7. The heat exchanger of claim 6, wherein the pressure reduction plate comprises first and second pressure reduction plates each having at least one aperture, wherein the first and second ends of the at least one tube are received in the at least one aperture of the respective first and second pressure reduction plates.

8. The heat exchanger of claim 1, wherein the sloped side walls of the at least one aperture are substantially flush with the at least one tube.

9. The heat exchanger of claim 1, wherein the pressure reduction plate substantially abuts the header plate.

10. A heat exchanger comprising:

first and second fluid reservoirs that retain a quantity of fluid;

a plurality of tubes that extend between the first and second reservoirs and circulate the fluid therebetween;

first and second header plates, retained respectively in the first and second reservoirs, through which the plurality of tubes are mounted; and first and second pressure reduction plates each having a plurality of apertures that respectively encompass first and second ends of each of the plurality of tubes, the plurality of apertures having tapered side walls that taper outwardly from the respective ends, to reduce turbulence of the fluid between the plurality of tubes and the first and second reservoirs, wherein each of the tapered side walls is of substantially constant thickness with an inner surface defining an inner radius of curvature and an outer surface exposed in the respective fluid reservoir, the outer surface extending between adjacent apertures and defining a half-section of a stadium of revolution.

11. The heat exchanger of claim 10, wherein the plurality of tubes each have a generally elongated sectional profile, so as to promote heat exchange with the ambient environment.

12. The heat exchanger of claim 10, wherein the first and second ends of the plurality of tubes protrude respectively through the first and second header plates.

13. The heat exchanger of claim 12, wherein the first and second ends of the plurality of tubes are received in the plurality of apertures of the respective first and second pressure reduction plates.

14. The heat exchanger of claim 10, wherein the tapered side walls of the plurality of apertures are curved side walls.

15. The heat exchanger of claim 14, wherein the inner surfaces of the curved side walls have a radius of curvature such that a ratio of the radius of curvature to a diameter of the plurality of tubes is at least 0.15.

16. The heat exchanger of claim 10, wherein the first and second pressure reduction plates respectively substantially abut the first and second header plates.

17. The heat exchanger of claim 1 wherein the at least one sloped side wall includes a first indentation that receives the end of the at least one tube and thereby renders the outer surface continuous with an inner surface of the at least one tube.

18. The heat exchanger of claim 10 wherein each of the tapered side walls includes first and second indentations respectively positioned at adjacent apertures, each of the first and second indentations receiving the end of the one of the plurality of tubes, thereby rendering the outer surface continuous with the inner surfaces of two of the plurality of tubes.

* * * * *